US008833819B2

(12) United States Patent
Chen

(10) Patent No.: US 8,833,819 B2
(45) Date of Patent: Sep. 16, 2014

(54) COVER WITH HANDLE STRUCTURE FOR FACILITATING HOLD A DEVICE AND METHOD OF USING THE SAME

(71) Applicant: Jen-Te Chen, Taipei (TW)

(72) Inventor: Jen-Te Chen, Taipei (TW)

( * ) Notice: Subject to any disclaimer, the term of this patent is extended or adjusted under 35 U.S.C. 154(b) by 0 days.

(21) Appl. No.: 13/654,586

(22) Filed: Oct. 18, 2012

(65) Prior Publication Data

US 2014/0110958 A1 Apr. 24, 2014

(51) Int. Cl.
*B65G 7/12* (2006.01)

(52) U.S. Cl.
USPC ..... 294/25; 224/217

(58) Field of Classification Search
USPC ..... 294/25, 137, 139, 138, 219, 150; 224/217, 218, 930; 206/320; 361/679.3, 679.55, 679.03, 679.56; 455/575.8; 248/125.7, 682, 444, 450
See application file for complete search history.

(56) References Cited

U.S. PATENT DOCUMENTS

| | | | | |
|---|---|---|---|---|
| 6,016,248 | A | 1/2000 | Anzai et al. | |
| 6,301,101 | B1 | 10/2001 | Anzai et al. | |
| 6,726,070 | B2 | 4/2004 | Lautner | |
| 7,735,644 | B2 * | 6/2010 | Sirichai et al. | 206/320 |
| 8,253,518 | B2 * | 8/2012 | Lauder et al. | 335/219 |
| 8,281,924 | B2 * | 10/2012 | Westrup | 206/320 |
| 2010/0122924 | A1 * | 5/2010 | Andrews | 206/320 |
| 2011/0163642 | A1 * | 7/2011 | Rohrbach et al. | 312/223.1 |
| 2011/0267748 | A1 | 11/2011 | Lane et al. | |
| 2012/0153116 | A1 * | 6/2012 | Harrison | 248/460 |
| 2012/0181195 | A1 * | 7/2012 | Lu et al. | 206/320 |
| 2012/0194308 | A1 | 8/2012 | Lauder et al. | |
| 2012/0267402 | A1 * | 10/2012 | Beatty | 224/218 |
| 2013/0020215 | A1 * | 1/2013 | Hsu | 206/320 |
| 2013/0020216 | A1 * | 1/2013 | Chiou | 206/320 |
| 2013/0134061 | A1 * | 5/2013 | Wu et al. | 206/320 |
| 2013/0140203 | A1 * | 6/2013 | Chiang | 206/320 |
| 2013/0258586 | A1 * | 10/2013 | Shao et al. | 361/679.55 |

* cited by examiner

*Primary Examiner* — Saul Rodriguez
*Assistant Examiner* — Gabriela Puig

(57) ABSTRACT

A cover with structure for facilitating hold a device enables a user to hold the device with plurality of faces stably. It can be configured to ridge a ridgeable portion and form a tubular space. The user can retain at least one finger in the space to hold the cover such that his palm can be placed more close to the center of the device to facilitate hold the device.

11 Claims, 10 Drawing Sheets

--Prior Art--

--Prior Art--

COVER WITH HANDLE STRUCTURE FOR FACILITATING HOLD A DEVICE AND METHOD OF USING THE SAME

CROSS-REFERENCE TO RELATED APPLICATIONS

This application claims priority based on Taiwan Patent Application Serial Number 100137811, filed on Oct. 19, 2011, the subject matter of which is incorporated herein by reference.

FIELD OF THE INVENTION

The present invention relates to a cover, and more particularly to a cover capable of forming a handle structure for facilitating a user to firmly hold a device with a plurality of faces.

BACKGROUND OF THE INVENTION

Portable devices are convenient to utilize their functions for users. But how to properly hold the portable devices while operating them, and avoiding accidentally dropping them, improving operating efficiency, and reducing operation injury and fatigue have become important subjects. Since post-PC era is coming and the tablet computers are getting popular, the subjects are more important than before.

FIGS. 1A and 1B show two traditional ways of holding a tablet computer. The way in FIG. 1A is not a lasting grasp because of the weight of the device and the torque it produced. The way in FIG. 1B is not comfortable and ergonomic because the outer frame is not designed for matching various holding angles, thus a user has to provide additional force to hold the device firmly.

U.S. Pat. No. 6,726,070 discloses an ergonomic input-device holder. A gun-shaped handle is attached to the bottom side of the holder for a user to grip for reducing the stress imposed on the wrist. Even though the handle can be folded, such a design is still not considered compact and lightweight as a whole.

For overcoming the problem of holding a tablet computer, many products use a belt to fasten the device on a hand of a user. A problem is the necessity of ensuring whether the belt is securely fixed while using. If the belt is replaced by an elastic belt, then the problem will be the reduction of elasticity of the elastic belt. The major problem is that the additional structure may affect usability of other functions and looks bulky. Moreover, its sense of designation is usually not coherent with the sense of technological electronic products.

U.S. Pat. Nos. 6,016,248 and 6,301,101 disclose an external structure for facilitating positioning and operation. In an aspect the external structure supports the device standing at different tilt angles, while in another aspect the external structure can be used as a hand strap for attachment to reduce the stress imposed on hand. Though the external structure is foldable and occupies no space, it cannot function as a cover, and provide only one grippable position that cannot support the device in both portrait and landscape orientations.

Smart Cover of the Apple Inc. is a cover for covering and protecting a device. It is a compact and lightweight design that can fit into daily life and nearly without affecting the usability of other functions. It can be positioned to form a triangular prism shaped space to serve as a standing support for using the tablet computer at different angles. However it does not have a handle structure for facilitating a user to hold the device firmly.

Accordingly, it's necessary to provide an improved handle structure which is capable of facilitating a user to hold the device firmly, and is a compact and lightweight design and nearly without affecting the usability of other functions.

SUMMARY OF THE INVENTION

In order to satisfy the need that has not been truly satisfied and solve the problems of the prior art, an objective of the present invention is to provide a cover having a handle structure for facilitating a user to firmly hold a device which has a plurality of faces, capable of being held as the position of a palm of the user is moved close to the center of the device, and thus reducing physical injury or fatigue while operating.

Another objective is to provide a cover having a handle structure, capable of being firmly held without the user' hand touching the main face of the touch device, and thus obtaining larger usable area of a human-machine interface (such as a screen) on the main face.

Another objective is to provide a cover having a handle structure, which has least affect on the usability of other functions, and does not look bulky.

Another objective is to provide a cover having a handle structure, which has a sense of designation coherent with the sense of technological electronic products.

Another objective is to provide a cover having a handle structure, capable of providing firmly hold to the device in either portrait or landscape orientation.

For achieving at least one of the above mentioned objective or other objective, the present invention provides a cover for covering a first face of a device with a plurality of faces. A first joint is configured for rotatably connecting the cover to the device. A ridgeable portion of the cover includes at least one second joint configured to flip and ridge outwardly from the device. The cover further includes at least one disconnected portion isolated from second joint. The cover is configured for being flipped to a second face of the device along the first joint and the second joint forms a ridge. A tubular space is formed inside the second joint for retaining a user's finger to hold the cover, such that the user' palm is moved close to the center of the device for facilitating hold the device.

In addition, a connecting element is disposed on the disconnected portion and a corresponding connecting element is disposed on the device, such that the disconnected portion is capable of being detachably fixed to the device.

In addition, a limiting element is disposed on the disconnected portion, and a corresponding limiting element is disposed on the device or the cover, such that the ridgeable portion remains at a predetermined angle for the user to hold the cover when the second joint forms a ridge.

In addition, the ridgeable portion in ridged configuration further has an opening for inserting a user's finger to facilitate hold. Furthermore, an openable cap is connected to the ridgeable portion and located corresponding to the opening.

In addition, the ridgeable portion in ridged configuration further has a handle portion for holding by a user's finger.

The present invention further provides a method of using a cover for covering a first face of a device with a plurality of faces. The method at least including the steps of: rotatably connecting the cover to the device through a first joint; flipping the cover to a second face of the device along the first joint; configuring the cover into a ridged configuration that a second joint is ridged outwardly from the device and forming a tubular space inside the second joint; and retaining a finger of a user into the tubular space to hold the cover, such that a palm of the user is moved close to the center of the device for facilitating hold the device.

In addition, the ridged configuration further includes a handle portion for fingers of the user to hold at two sides thereof.

Furthermore, one side of the handle portion is configured for inserting at least one finger of the user into the tubular space, and being supported in cooperation with the palm of the user to facilitate hold the device.

In addition to the above mentioned method, the user can further stretch a finger to grip a grippable element on the cover to firmly hold the device. Furthermore, the grippable element is a outer frame of the device.

BRIEF DESCRIPTION OF THE DRAWINGS

The present invention will become more readily apparent to those ordinarily skilled in the art after reviewing the following detailed description and accompanying drawings, in which.

DETAILED DESCRIPTION OF PREFERRED EMBODIMENTS

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 2:
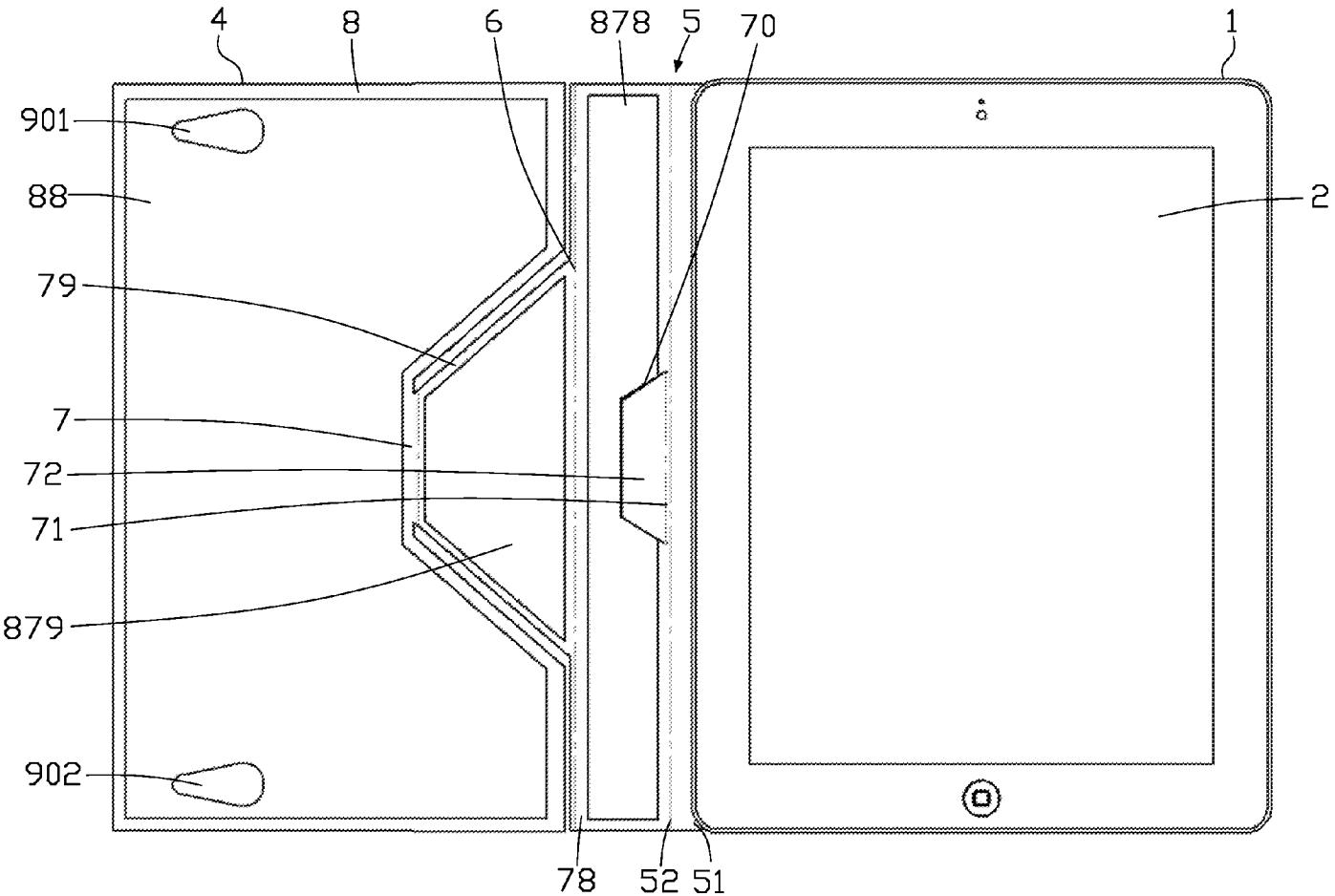
FIG. 2 is a schematic view of the first embodiment of the present invention.
Figure 3:
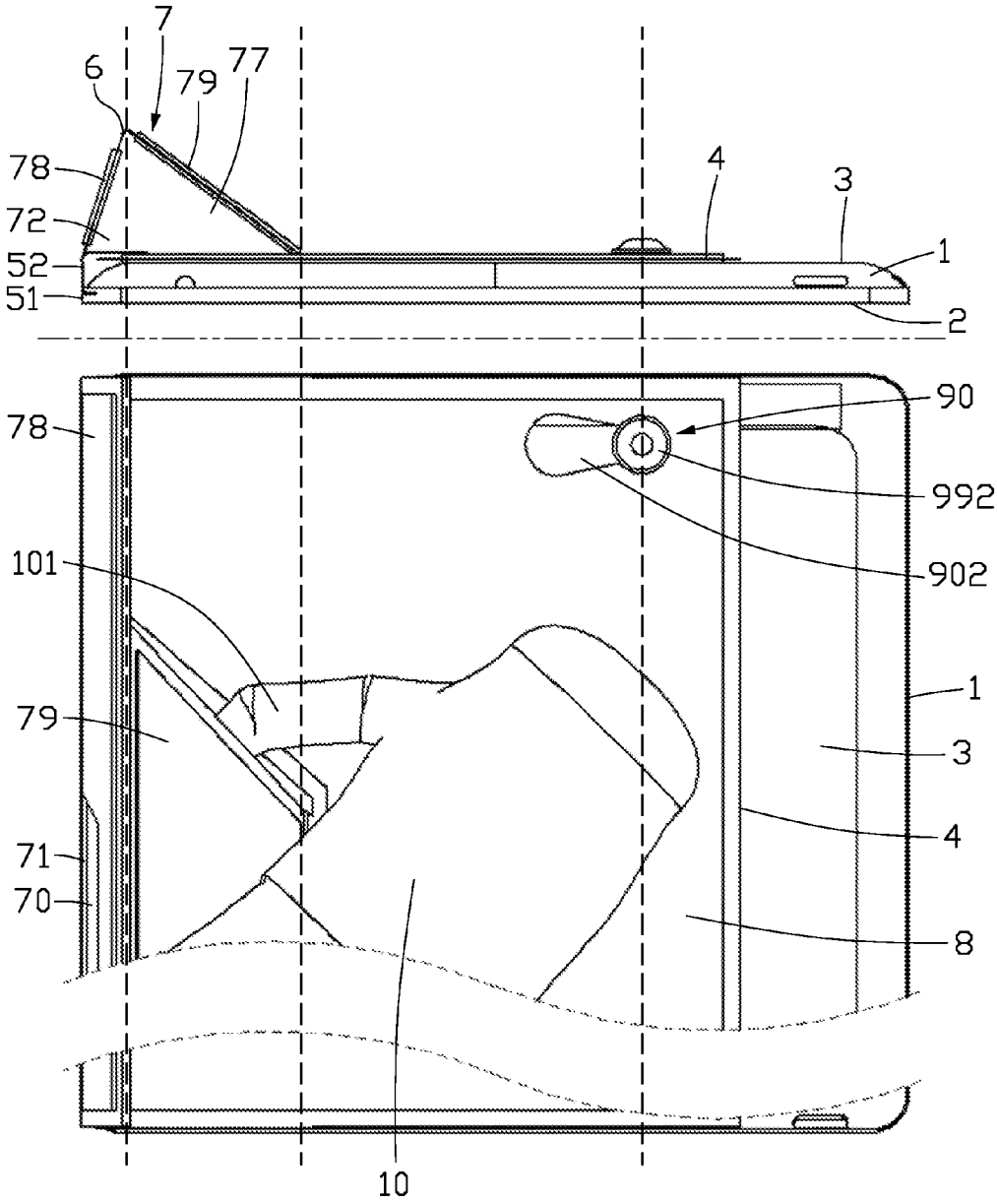
FIG. 3 is a schematic view showing a ridged configuration of the first embodiment of the present invention.
Figure 4:
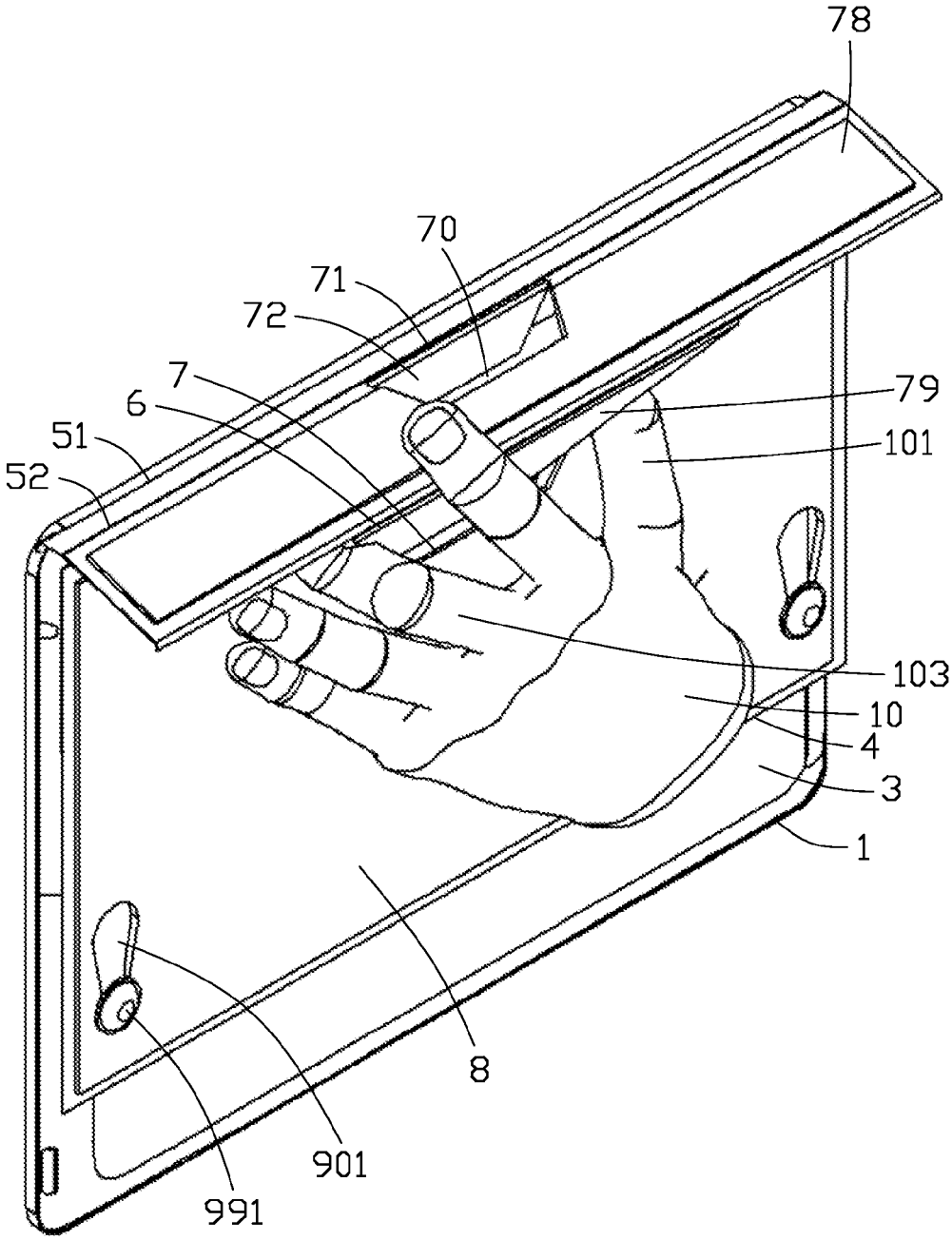
FIG. 4 is a schematic view of the first embodiment of the present invention, showing a rear view of a status that the cover 4 is held by user's hand.

FIG. 2, FIG. 3 and FIG. 4 are schematic views of the first embodiments of the present invention. FIG. 2 is a schematic view showing a front view of a cover 4 according to the first embodiment of the present invention, which is similar to a book without closing its cover. FIG. 3 is a schematic view showing the cover 4 in a ridged configuration formed by flipping the cover 4 to the back side of the device 1. A long broken line is used for separating a side view in the upper part and a rear view in the lower part for demonstrating the relationship of the elements in a ridged configuration. Reference numerals in the views of the upper and lower parts are marked for convenient description. A user's hand and fingers are additionally introduced for demonstrating the interrelationship between them while operating. FIG. 4 is a schematic view showing a rear view of a status that the cover 4 held by user's hand.

The present invention discloses a cover 4 for covering a first face 2 of the device 1 which has a plurality of faces, which at least including a first joint 5, a ridgeable portion (as labeled as 78, 6, 79), and a disconnected portion 8. The first joint 5 is used for rotatably connecting the cover 4 to the device 1. The ridgeable portion (as labeled as 78, 6, and 79) includes at least one second joint 6, which can be flipped and ridged outwardly from the device 1. The disconnected portion 8 is isolated from the second joint 6. The cover 4 can be flipped to a second face 3 of the device 1 along the first joint 5, and can ridge the ridgeable portion (78, 6, and 79). A tubular space 77 is formed inside the second joint 6 and configured for retaining a user's finger 101 to hold the cover 4, such that the user' palm 10 can be moved close to the center of the device 1 for facilitating hold the device 1. A more detailed description is made as follows The cover 4 in the drawing can be substantially divided into: the first joint 5 connected to the device 1, a long and narrow rectangular one part 78 of the ridgeable portion, and a large rectangular part consisting of a trapezoid handle portion 79 and a disconnected portion 8. The one part 78 of the ridgeable portion is connected with the first joint 5. The trapezoid handle portion 79 is connected to the one part 78 of the ridgeable portion through the second joint 6, and is connected to the disconnected portion 8 through a disconnected portion joint 7.

The cover 4 is rotatably connected to the device 1 by the first joint 5. The second joint 6 is capable of being flipped and ridged outwardly from the device 1. The connection manner includes, but not limited to, hinged connection, pivotal connection and foldable structure. Other familiar manners or manners with the same effect can be adopted as well. The first joint 5 in this embodiment of the drawing is a foldable mechanism using a double hinged connection including a first hinged portion (folding line 51) and a second hinged portion (folding line 52). The purpose of the double hinged connection is to compliantly attach the cover 4 either to the first face 2 or to the second face 3. The second joint 6 and the disconnected portion joint 7 are also foldable structures, so they can both be made by using typical protective device cover material.

Referring to FIG. 2, the first face 2 of the device 1 is the face where the touch screen is located. The main purpose of the cover 4 is to be flipped to cover the first face 2 of the device 1 along the first joint 5. Because of the shielding of the cover 4, the first surface 2 can avoid the direct influence from external force or external substance. Requirement to the material of the cover 4 is to maintain the ridged configuration and structure thereof while operating. Through designation and using appropriate material composition, the purpose of structure formation, protection and dust proofing can be achieved. Prior arts such as US patent 20110163642 and others can be considered as reference. For example, the elements 8, 78, 79 each have enhanced areas 88, 878, 879 with hard lining material for enhancing mechanical strength of covering protection. The numerals of the enhanced areas in the other figures are not labeled without necessity for reason of simplifying.

Referring to FIG. 3, the cover 4 of the present invention can be further formed with a handle structure, which is flipped to the second face 3 of the device 1 along the first joint 5 and the second joint 6 is flipped and ridged outwardly from the device 1. Thus, the ridgeable portion includes the one part 78 of the ridgeable portion, the handle portion 79, the outwardly ridged second joint 6, and a triangular tubular space 77 formed inside the second joint 6. If the device has heat dissipating device such as heat dissipating holes, the tubular space 77 can be used for dissipating heat from certain area of the device where is not covered by the cover. The disconnected portion 8 which is not connected with the second joint 6 is connected to the handle portion 79 through the disconnected portion joint 7 and is compliantly attached to the back face 3 of the tablet computer.

The present invention can adopt a connecting element set 90 for connecting the device 1 and at least one disconnected portion 8. And the connection is detachable. Referring to FIG. 2 and FIG. 4, the disconnected portion 8 is formed with connecting elements 901, 902, which each is composed of a large opening, a small opening and a tunnel between the large opening and the small opening. The tunnel is not smaller than the small opening. Corresponding connecting elements 991, 992 are disposed on the device 1. Each of the corresponding connecting elements 991, 992 has a head portion which is not larger than large opening, and a post portion (not shown) which is not larger than the small opening. The corresponding connecting element set 90 is a conventional art and is not repeated herein. The function of the connecting element set 90 is to detachably connect the disconnected portion 8 to the device 1 when the second joint forms a ridge The connecting elements can be selected from any known connecting elements. For example, hook and buckle, or hook and loop band are workable substitutions. The purpose of the elements is to detachably fix the disconnected portion 8 to the device 1 while ridging the ridgeable portion (78, 6, and 79). Therefore, whatever elements adopted which can achieve the above mentioned purpose can be considered as an appropriate equivalent, including the cover itself. The application range of the connected elements of the present invention should include various kinds of known alternative fasteners for constituting the above mentioned connecting element set 90.

As the lower part of FIG. 3 and FIG. 4 show, the user can insert finger 101, 103 into the triangular tubular space 77 for holding the cover 4 such that the user's palm can be moved close to the center of the device 1 for facilitating hold the device 1.

Figure 5:
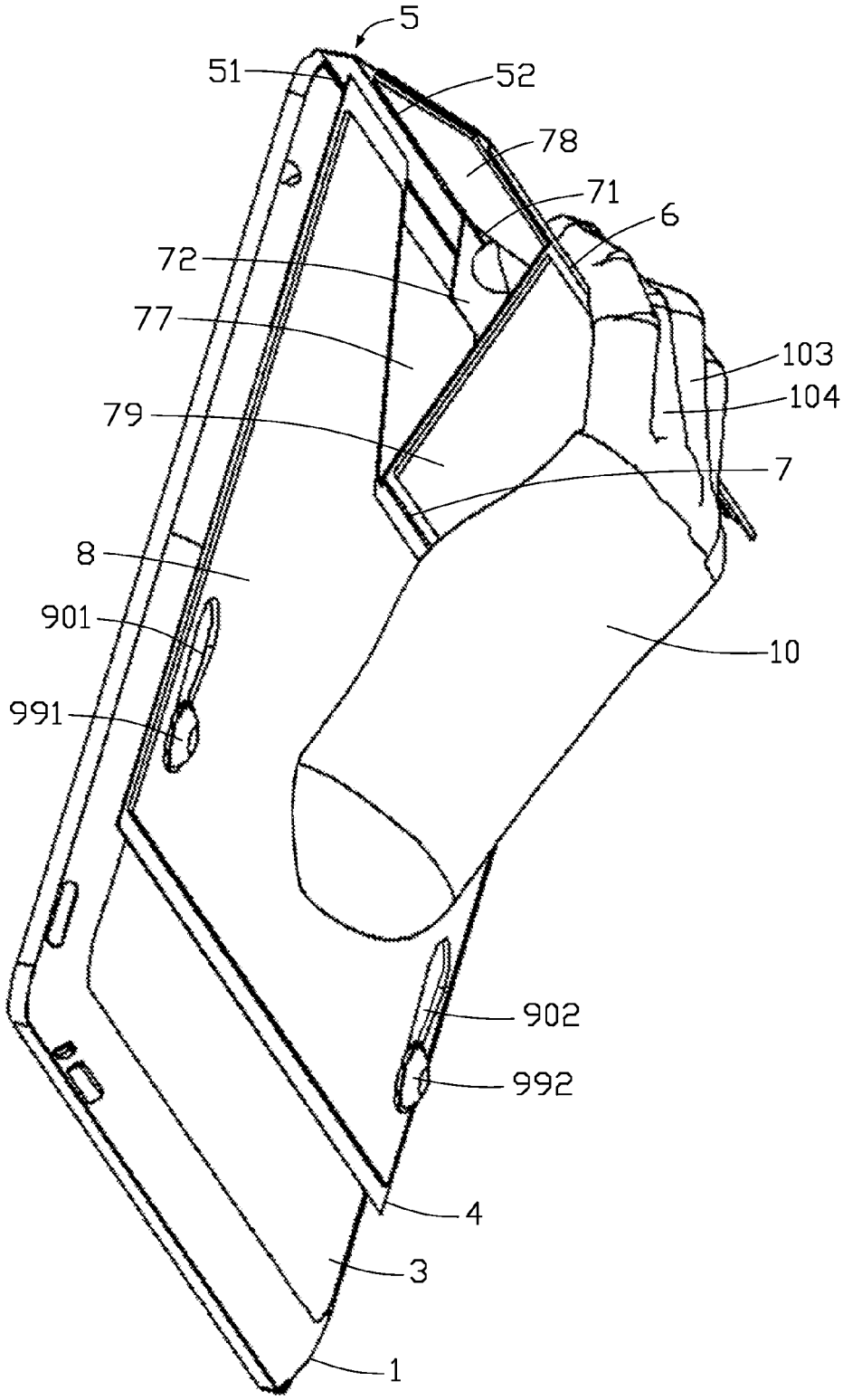
FIG. 5 is a schematic view of the first embodiment of the present invention, demonstrating an opening is formed in the ridgeable portion for inserting a finger to facilitate hold.

The ridgeable portion disclosed in the first embodiment further has an opening located on the one part 78 of the ridgeable portion. The opening is provided by forming an opening cut line 70, and thus an openable cap 72 is formed and a hinged portion 71 of the openable cap is conneceted to the ridgeable portion. As FIG. 5 shows, the opening is provided for inserting fingers 103, 104 to facilitate hold. Trough the opening to hold the cover 4, the user's palm can also be moved close to the center of the device 1 to facilitate hold. If the opening cut line 70 extends to include the hinged portion 71 of the openable cap, the openable cap can be omitted and an opening is left there. Such a configuration can also be held as the way shown in FIG. 5, but less protective area can be provided by the cover 4 because the openable cap 72 is removed.

The present invention further has limiting elements set. One of the limiting elements is located on the at least one disconnected portion of the cover, and another limiting element is correspondingly located on the device or the cover. When the second joint forms a ridge, the user can hold the cover and the ridgeable portion remains at an angle. Referring to FIG. 5, when the user is holding the cover 4, and the connecting elements 901, 902 and corresponding connecting elements 991, 992 are omitted, the disconnected portion 8 abuts against the second hinged portion (folding line 52) of the first joint 5, such that the ridgeable portion (78, 6, and 79) remains at an angle. So the limiting element in this configuration is the disconnected portion 8 of the cover, which is corresponding to the first joint 5 of the cover. Similarly, a protruding groove can be disposed on the back face of the device 1 for bearing against the disconnected portion 8 and remaining the ridgeable portion at another angle. Another workable alternative is to be disposed a protrusion on the upper peripheral edge of the disconnected portion 8 as a limiting element, which is corresponding to a hole on the one part 78 of the ridgeable portion. The disconnected portion 8 may define an angle with the device 1 instead of compliantly attached. In conclusion, the purpose of the limiting element is only to fix the angles at two sides of the second joint when the cover is arranged to ridge the ridgeable portion. Therefore, whatever elements adopted which can achieve the above mentioned purpose can be considered as an appropriate equivalent, including the cover itself.

Figure 6:
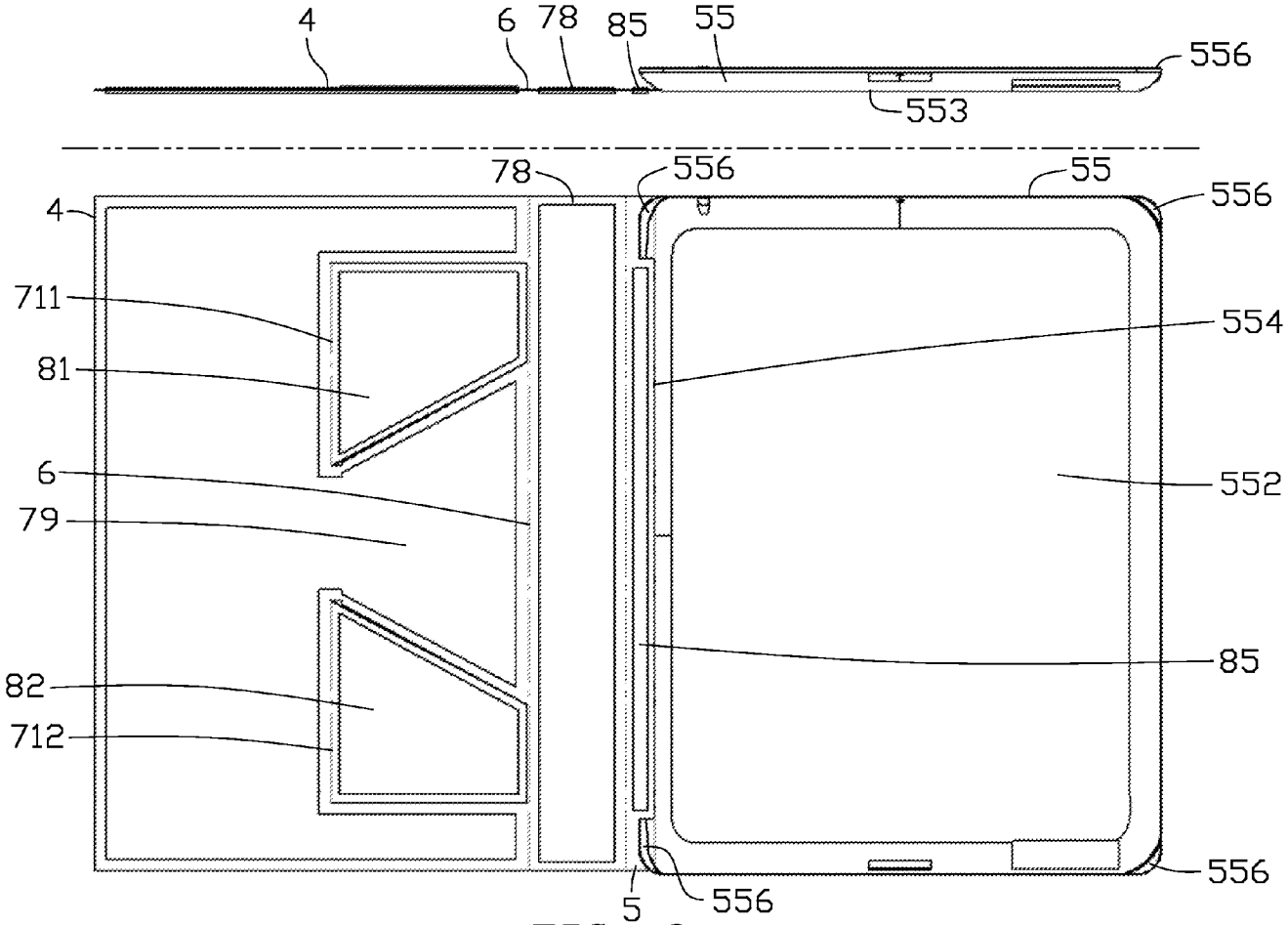
FIG. 6 is a schematic view of the second embodiment of the present invention.
Figure 7:
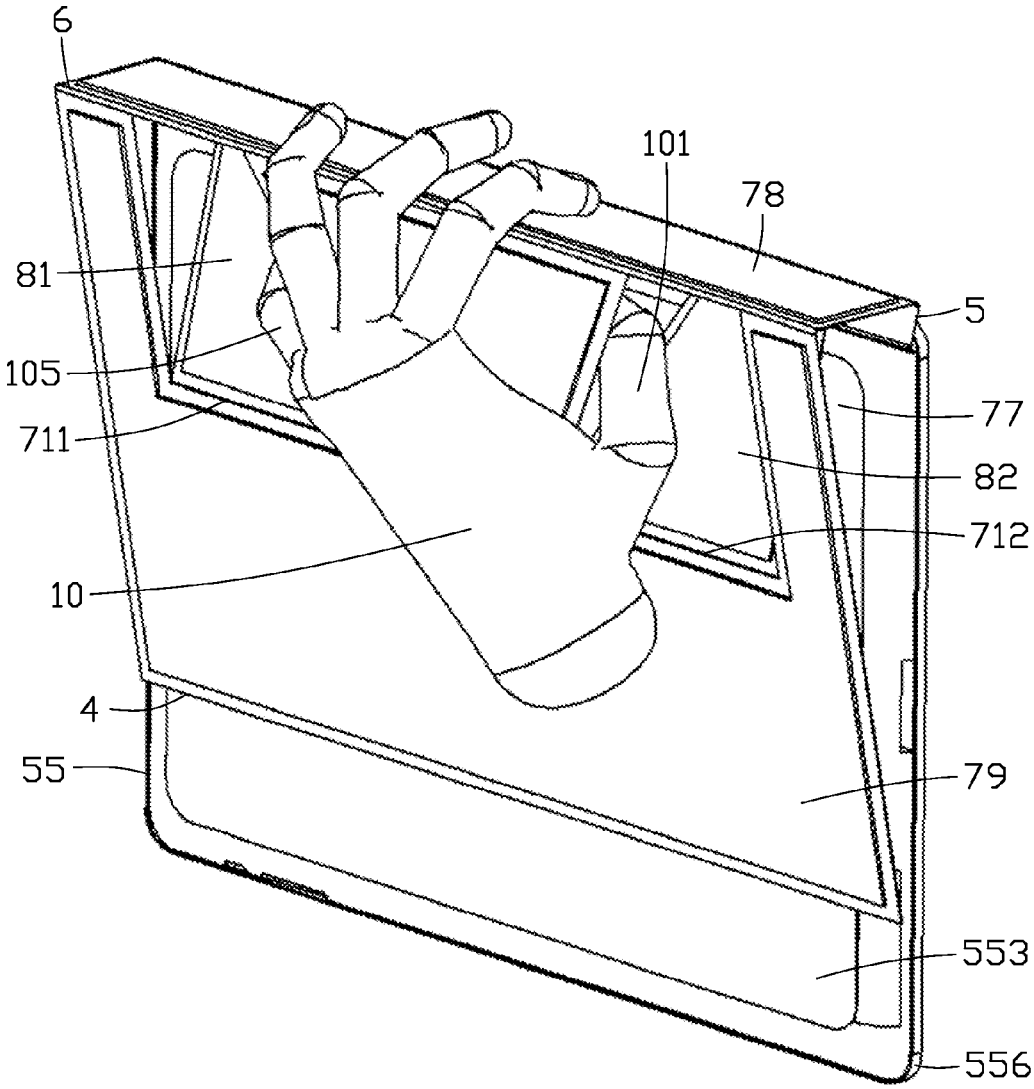
FIG. 7 is an operating view of the second embodiment of the present invention.

The second embodiment of the present invention demonstrates another workable assembly method of the first joint 5 and a design of the cover. As FIG. 6 and FIG. 7 show, according to the present invention the cover 4 is rotatably connected to a protective shell 55 for a tablet computer. Through a protective shell fixing means, a front face 552 of the protective shell 55 is attached to the tablet computer (not shown), and the protective shell 55 is fixed on the tablet computer. In practical use, a back face 553 of the protective shell is equivalent to the second face of the device. The protective shell fixing means in the drawing is to utilize the edges 556 of the four corners of the protective shell to seize the outer frame of the tablet computer after the protective shell is combined with the tablet computer.

The first joint 5 of the embodiment in the drawing is the same as the above mentioned double hinged structure. Furthermore, a enhanced area 85 with hard lining material can be integrated into the first joint 5, which is in cooperation with the one part 78 of the ridgeable portion and the other enhanced areas to reduce practical limiting configuration of the disconnected portion.

The cover 4 and the protective shell 55 in FIG. 6 can be combined to the tablet computer as shown in FIG. 3 and can be operated as shown in FIG. 7. The cover 4 is rotatably connected to a second face (equal to 553) of the device (not shown) through a first joint 5. The ridgeable portion (78, 6, and 79) is ridged. A tubular space 77 is formed inside the second joint 6. Fingers 101, 105 of a user can be inserted in the tubular space 77 to hold the cover 4, such that the palm 10 of the user is moved close to the center of the device for facilitating hold the device.

The disconnected portion of the embodiment in the drawing includes two pieces of trapezoid shaped structures, which each have a long base line connected to the handle portion 79 through two disconnected joints (711, 712). In the ridged configuration, the disconnected portions (81, 82) are inwardly rotated for bearing against a jointed portion between the enhanced area 85 and the one part 78 of the ridgeable portion and providing support. The two pieces of the trapezoid shaped structures (81, 82) can further be connected to each other with additional material so that they can be moved together for more convenient operation. The protective shell 55 further has a U-shaped recess 554 corresponding to the enhanced area 85 on the first joint 5 while the cover 4 is being closed as a book.

The practical using method of the cover of the present invention is further detailed below. Referring to the FIG. 3 and FIG. 4, and the above mentioned description of assembly. According to an embodiment of the present invention, a method of using the cover 4 for covering a first face 2 of a device 1 with a plurality of faces at least including the steps of: rotatably connecting the cover 4 to the device 1 through a first joint 5; flipping the cover 4 to a second face 3 of the device 1 along the first joint 5; configuring the cover 4 into a ridged configuration that a second joint 6 is ridged outwardly from the device 1 and forming a tubular space 77 inside the second joint 6; retaining a finger 101 into the tubular space 77 to hold the cover 4, such that a palm 10 is close to the center of the device 1 for facilitating hold the device 1.

FIG. 4 demonstrates that the cover 4 in the ridged configuration provides an inverted trapezoid shaped handle portion 79 for fingers (101, 103) of the user to hold at two sides thereof.

FIG. 5 demonstrates an opening formed in the ridgeable portion 78 for inserting a finger to facilitate hold. Such a method does not need a handle portion 79 for holding at two sides, the user needs only to attach the palm 10 to the cover 4 in the ridged configuration.

Figure 1A:
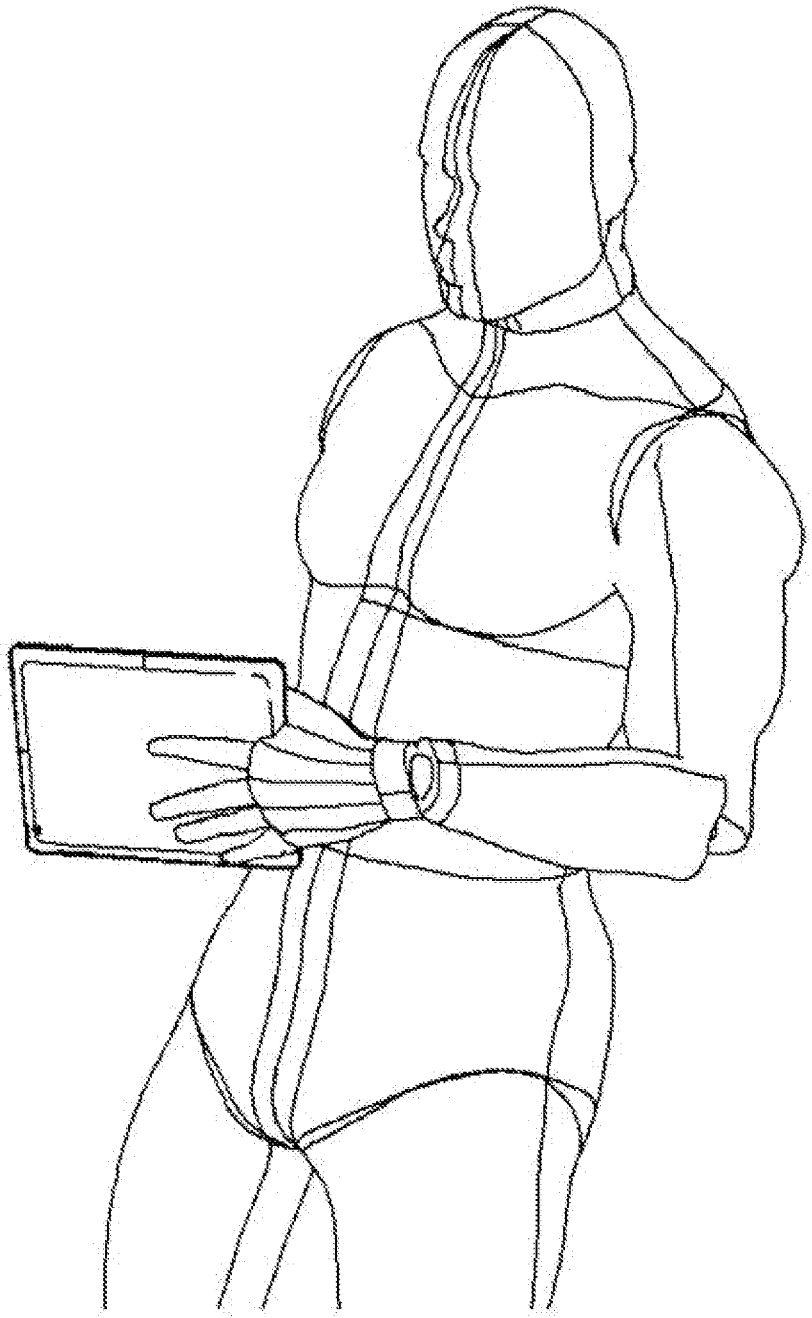
FIG. 1A shows a traditional way of holding a tablet computer.
Figure 1B:
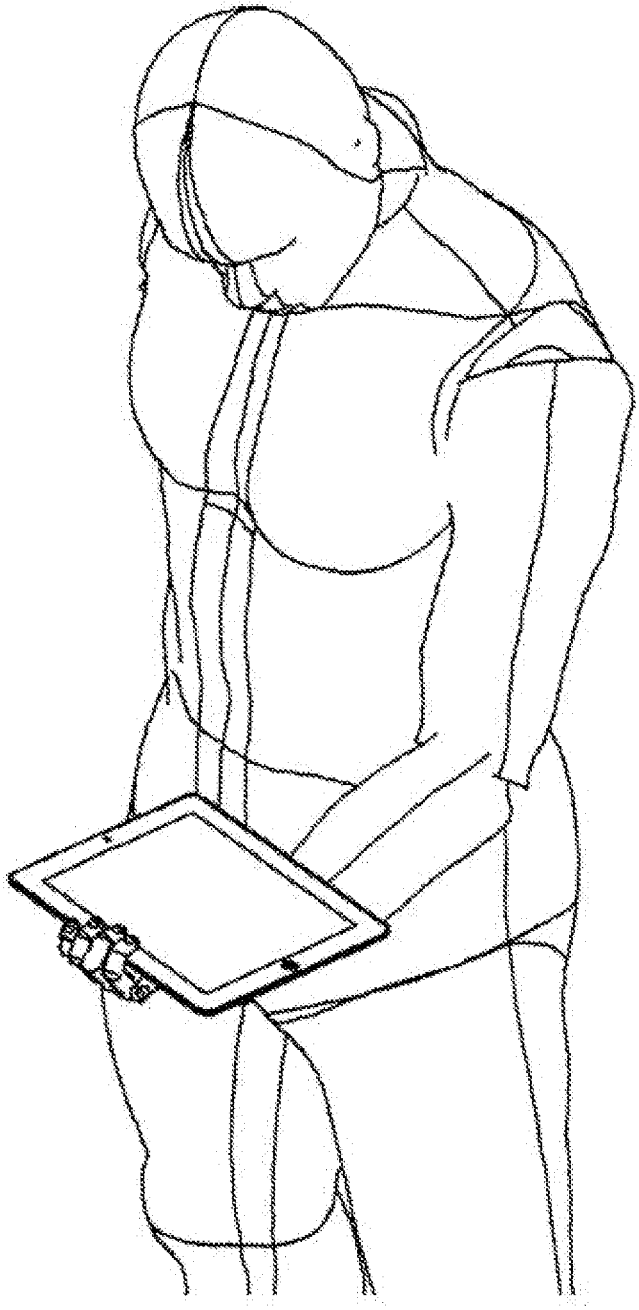
FIG. 1B shows another traditional way of holding a tablet computer.

The conventional method for holding a tablet computer is shown in FIG. 1A and FIG. 1B, the palm of the user is close to the outer frame of the device. In comparison, the holding method in FIG. 4 and FIG. 5 apparently makes the palm 10 moved close to the center of the device 1 to facilitate hold.

Figure 8:
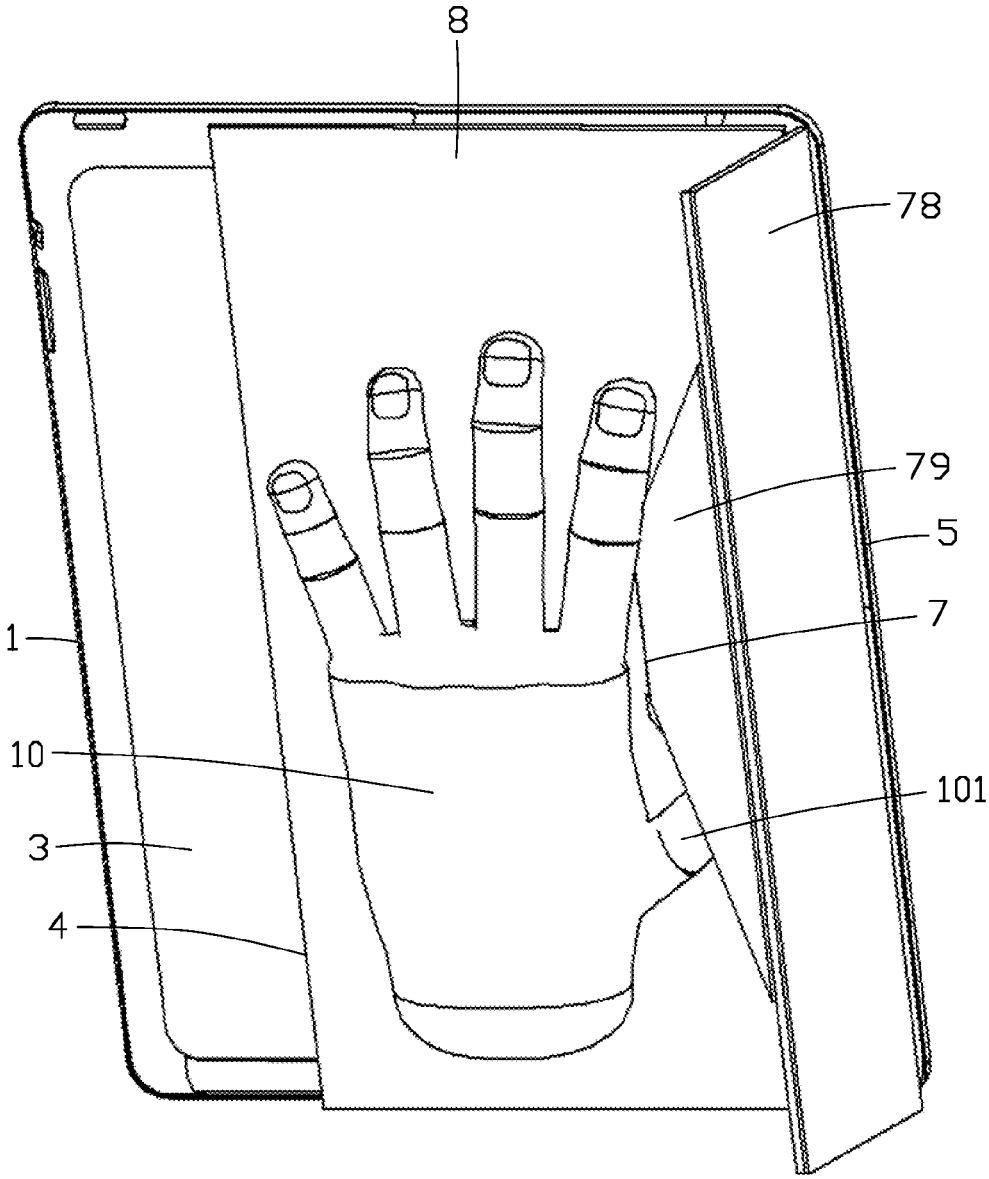
FIG. 8 a schematic view of the third embodiment of the present invention, showing a rear view of a status that a finger is inserted inside the handle portion in cooperation with a palm supporting the device to facilitate hold of the device.
Figure 9:
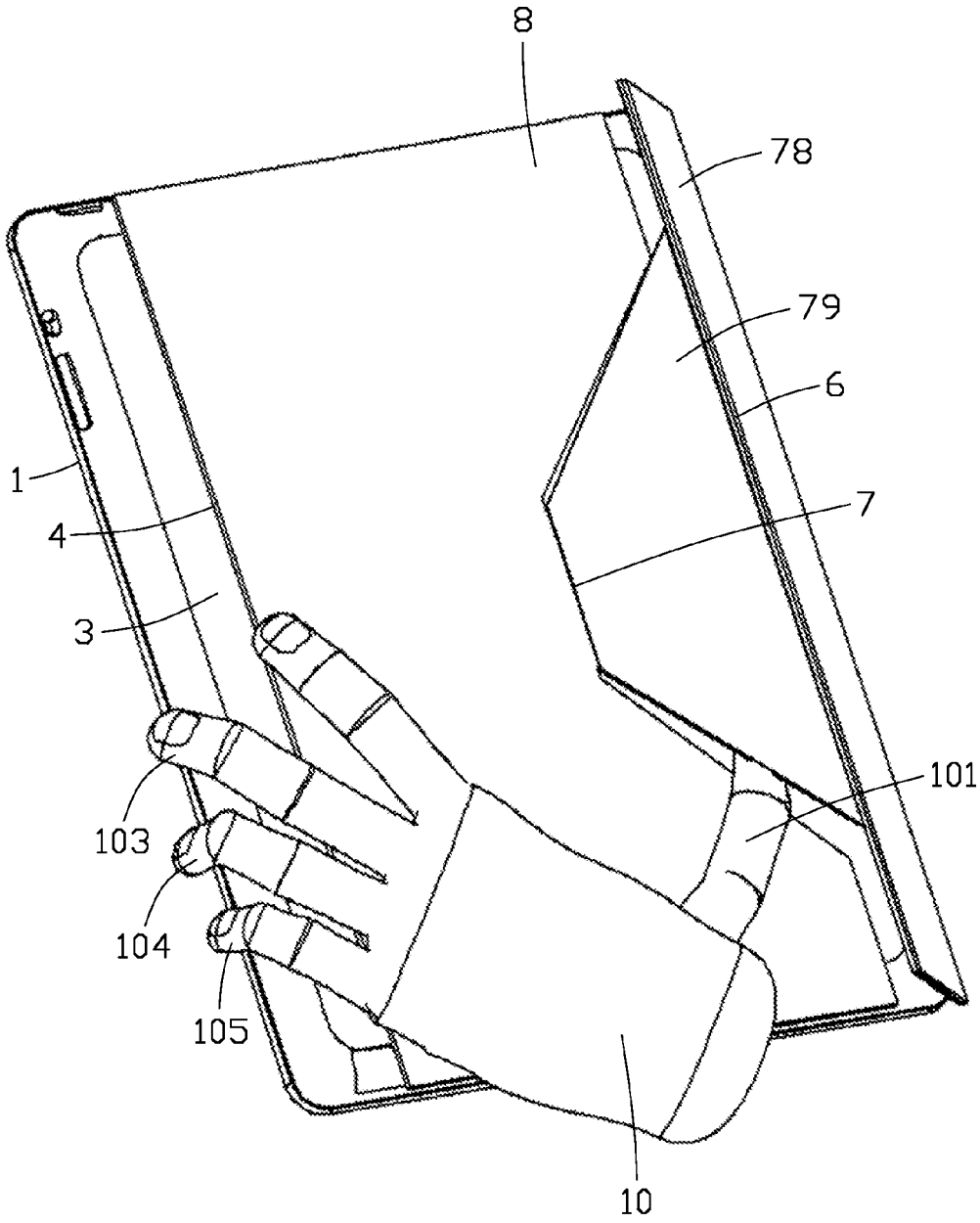
FIG. 9 a schematic view of the third embodiment of the present invention, showing a rear view of a status that a free finger stretches to seize the edge of the device for firmly hold the device.

FIG. 8 and FIG. 9 show a cover according to the third embodiment of the present invention, which is similar to the cover of the first embodiment. The difference is that the cover of this embodiment does not have enhanced areas and the ridgeable portion (78, 6, and 79) does not have the opening and the joint. The workable material of the cover is polypropylene (PP) with an appropriate thickness or other plastic material and combination thereof. The second joint 6 and the disconnected portion joint 7 can be not only the above mentioned hinged connection, pivotal connection, but also a linking design of plastic hinge, which can be one-piece formed by plastic molding and thus reducing the manufacturing cost.

The disconnected portion 8 is the same as that of the second embodiment. The disconnected portion 8 itself is also a limiting element. The disconnected portion 8 cooperates with the first joint 5, as the corresponding limiting element, of the cover 4. The holding method is similar to the practically workable method shown in FIG. 4 and FIG. 7, and not repeated herein.

The third embodiment is used hereinafter for describing others using methods of the cover of the present invention. Coinciding with the spirit of the present invention with appropriate conditions, the other using methods can also be implemented on various practical embodiments. As FIG. 8 shows, while the cover 4 is ridged from the second face 3 of the device 1, a handle portion 79 is formed for inserting at least one finger (a left hand's thumb 101) from a side thereof into the space formed inside the second joint 6, in cooperation with the palm 10 to support the device 1 to facilitate hold the device 1. Since the finger is retained in the tubular space, user can cope with sudden external forces, and thus avoiding dropping the device 1. Moreover, the area between the thumb and the index finger can touch against the edge of the handle portion 79, which makes hold more firmly.

Due to the weight of the device 1, when the device is held close to perpendicular, the friction force between the cover 4 and the device 1 will be lowered. The cover 4 will rotate in clockwise direction with respect to the device 1. At the time the edge of the upper right corner of disconnected elements 8, as the limiting element, contacts against the first joint 5 of the cover 4, as the corresponding limiting element. By the similar holding method in FIG. 7, the rest part of the edge of the first joint 5 will be isolated. The rotating movement is limited by the physics of the cover and the mechanical characteristics, and is designed to be controlled in an appropriate range and will not affect the usability. Properly selection of the limiting element set can reduce or avoid the problem.

When the inclined angle of the device is too large, the device will rotate with respect to the first joint 5, and the second face 3 will be separated from the device 1, and even separated from the ridged configuration. In most of the conditions, the inclined angle is not large enough for the device to separate from the ridged configuration. Appropriate selection of the connecting elements can completely avoid this problem.

In addition, the user can further stretch at least one additional finger to grip a grippable element to firmly hold the device. The purpose is to provide a second gripping point on the device to ensure the ridged configuration, such that any equivalent for finger to grip can be used. Such equivalent may include, but not limited to, grooves or ring-shaped members.

Referring to FIG. 9, the grippable element is an outer frame of the device 1. The user can stretch fingers 104, 105 that are not retained in the tubular space to grip the outer frame of the device 1 and firmly hold the device. In comparison to the FIG. 8, the disconnected portion 8 is no longer against the limiting elements (the first joint 5) and moved toward the left side in the drawing. The ridgeable portion (78, 6, and 79) is kept in a lower profile position. At the time the finger in the tubular space limits the lower range of the ridgeable portion. This holding method minimizes the problem of the rotating movement since the device is gripped, and the above mentioned problem of separating from the ridgeable configuration will not occurred.

As FIG. 8 and FIG. 9 show, a simplified embodiment of the present invention, in comparison to the other embodiments, this embodiment apparently is filled with sense of designation and is coherent with the sense of technological electronic products.

As FIG. 4, FIG. 8 and FIG. 9 show, the cover of the present invention and using method can be hold firmly whenever the device is arranged either vertically or horizontally.

Although the embodiments of the present invention use tablet computer for illustration, the cover of the present invention can be used for various devices such as facilitating hold of a laptop computer. As an obvious example, the back face of the display screen of the laptop computer is used as the first face, and the first joint of the cover is parallel connected to the hinge of the laptop computer, such that the cover is able to be flipped to the back face of the keyboard of the laptop computer. A suitcase type carrying bag is considered to have an upper cover and a lower cover. By a fixing means, the base of the laptop is fixed to the lower cover. The upper cover can be fixed to cover the screen of the laptop computer, or to be flipped to the back face of the laptop computer (the outer side of the lower cover). In order to realize the present invention, an inner cover can be additionally connected to either the upper cover or parallel to the hinges of the upper and the lower covers.

The characteristics of the present invention is that the user can put a finger into the tubular space formed from the ridged cover, to hold the cover, so that the palm is moved close to the center of the device to facilitate hold the device. Therefore, the problem that the device cannot be held in a long time due to the weight of the device and generated torque can be solved. In another aspect, since the user can hold the device by the cover, the designation of the outer frame of the device can obtain more freedom.

The cover and its using method of the present invention, the cover can provide function of protecting the human-machine interface (such as screen) on the main face (the first face) of the device. While using it, the user's hand can firmly hold the device without touching the main face of the device. Such that a touch panel with a narrower outer frame can be adopted to obtain larger operating area of the human-machine interface. In cooperation with algorithms for detecting the size of the touching area when the device is held by hand, the usable range of the human-machine interface can be controlled, and the statuses of cover held and outer frame held can be dynamically adapted. And thus a device with smaller dimensions but having a relative large usable area of the human-machine interface can be provided.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A cover for covering a first face of a device with a plurality of faces, the cover comprising:

a first joint configured for rotatably connecting the cover to the device;

a ridgeable portion comprising at least one second joint and at least two parts separated by the said second joint configured to flip and ridge outwardly from the device; and disconnected portion isolated from the second joint;

wherein the cover is configured for being flipped to a second face of the device along the first joint and the second joint forms a ridge, and a tubular space is formed inside the second joint for retaining a user's finger to hold the cover, such that a palm of the user is moved close to the center of the device for facilitating hold the device.

2. The cover according to claim 1, further comprising a connecting element disposed on the disconnected portion and a corresponding connecting element disposed on the device, such that the disconnected portion is capable of being detachably fixed to the device.

3. The cover according to claim 1, further comprising a limiting element disposed on the disconnected portion, and a corresponding limiting element disposed on the device or the cover, such that the ridgeable portion remains at a predetermined angle for the user to hold the cover when the second joint firms a ridge.

4. The cover according to claim 1, wherein the ridgeable portion has an opening for inserting a finger of the user to facilitate hold.

5. The cover according to claim 4, further comprising an openable cap connected to the ridgeable portion and located corresponding to the opening.

6. The cover according to claim 1, further comprising a handle portion for holding by a finger of the user.

7. A method of using a cover for covering a first face of a device with a plurality of faces, the method at least comprising the steps of:

rotatably connecting the cover to the device through a first joint;

flipping the cover to a second face of the device along the first joint;

configuring the cover into a ridged configuration that a second joint is ridged outwardly from the device and forming a tubular space inside the second joint; and retaining a finger of a user into the tubular space to hold the cover, such that a palm of the user is moved close to the center of the device for facilitating hold the device.

8. The method according to claim 7, wherein the ridged configuration further comprising a handle portion for fingers of the user to hold at two sides thereof.

9. The method according to claim 8, wherein one side of the handle portion is configured for inserting at least one finger of the user into the tubular space, and being supported by the palm of the user to facilitate hold the device.

10. The method according to claim 9, wherein the user further stretches a finger to grip a grippable element to firmly hold the device.

11. The method according to claim 10, wherein the grippable element is an outer frame of the device.

* * * * *